US005669552A

United States Patent [19]

Watanabe

[11] Patent Number: 5,669,552

[45] Date of Patent: Sep. 23, 1997

[54] CONTAINER FOR TEMPORARY STORAGE OF FOOD ITEMS

[75] Inventor: Michael E. Watanabe, Nampa, Id.

[73] Assignee: Boise Cascade Corporation, Boise, Id.

[21] Appl. No.: 520,105

[22] Filed: Aug. 28, 1995

[51] Int. Cl.[6] ..... B65D 5/66; B65D 5/68

[52] U.S. Cl. ..... 229/114; 229/125.19; 229/149; 229/906

[58] Field of Search ..... 229/114, 902, 229/906, 125.01, 125.19, 140, 150, 151, 152

[56] References Cited

U.S. PATENT DOCUMENTS

| | | | |
|---|---|---|---|
| 1,618,325 | 2/1927 | Chalmers | 229/125.01 |
| 3,744,707 | 7/1973 | Ross | 229/125.01 |
| 3,912,331 | 10/1975 | Turner et al. | 229/125.01 |
| 4,362,266 | 12/1982 | Webinger | 229/114 |
| 4,586,648 | 5/1986 | Josefsson et al. | 229/114 |
| 4,765,534 | 8/1988 | Zion et al. | 229/152 |
| 5,226,587 | 7/1993 | Eisman et al. | 229/114 |
| 5,249,736 | 10/1993 | Eisman | 229/114 |
| 5,411,204 | 5/1995 | DeMay | 229/114 |
| 5,431,333 | 7/1995 | Lerenz | 229/114 |

*Primary Examiner*—Gary E. Elkins

*Attorney, Agent, or Firm*—Klarquist Sparkman Campbell Leigh & Whinston, LLP

[57] ABSTRACT

A container for storage and transportation of foods which can accommodate various sizes of foods depending upon the orientation of the container is disclosed. The container includes flat surfaces separated by obliquely angled side walls thus presenting an appearance similar to an eight-sided frustrum of a cone. With the large flat portion oriented downward the container may be opened and a large food item may be stored and transported in the container. Conversely, with the smaller flat portion oriented downward a somewhat smaller food item may be stored and transported in the container. Additionally, the container is configured so that multiple containers can be nestingly stacked together for efficient shipping. Thus, the container may be configured at a manufacturing facility and shipped in a fully assembled condition thus simplifying the use of the container at a retail service facility. Additionally, the factory assembly allows the use of adhesive which provides a more secure structural attachment than can be achieved with the tab and slot method common with most food containers that are designed for on-site assembly.

3 Claims, 9 Drawing Sheets

CONTAINER FOR TEMPORARY STORAGE OF FOOD ITEMS

BACKGROUND OF THE INVENTION

1. Field of the Invention

This invention pertains to corrugated boxes used for temporary storage and transportation of food, such as pizzas. This invention further pertains to temporary food containers that can be assembled at a manufacturing location and nestingly stacked for shipment and storage while awaiting use. This invention further pertains to a temporary storage container that is capable of receiving and supporting at least two different sizes of food items.

2. Description of the Related Art

Corrugated materials have sufficient structural strength and insulating properties to be useful as temporary storage for hot foods. A well-known example is the pizza box for "take out" pizza.

Prior-art pizza boxes typically have a square cross section and include a bottom having integral sides which extend upward from the base at a 90° angle. An integral top is hingedly connected to one of the upstanding sides. Generally, the top will have its own sides depending at a 90° angle so that, as the top is closed over the bottom, the sides of the top fit within the sides of the bottom.

The top and bottom are substantially the same size. To accommodate different sizes of pizzas, different sizes of pizza boxes are made in appropriate corresponding sizes. Accordingly, for example, a large pizza would use a large pizza box, and a medium pizza would use a medium pizza box.

To conserve shipping space, conventional pizza boxes are typically shipped to a service outlet as flat "blanks," which are ready-to-assemble sheets of corrugated board. Accordingly, prior to use, it is necessary for the service employees to assemble the boxes, which requires training and employee time. Also, an improperly assembled box may not provide sufficient support and protection for pizzas and could thus be inconvenient to customers.

Therefore, there has been a long-standing need in the industry for preassembled pizza boxes that can be preassembled at a manufacturing facility and efficiently shipped to the retail outlet. Additionally, it has long been a problem that differently sized boxes are required to securely hold differently sized pizzas.

SUMMARY OF THE INVENTION

The present invention is directed to a food container which includes (when closed) opposed, differently-sized planar surfaces separated, and joined, by oblique sides. The planar surfaces are differently sized so that the container can suitably support food items of different sizes, depending upon which planar surface is used to support the food item. Accordingly, a container according to the present invention that is adapted for pizza storage may have one planar surface sized to snugly receive and support a medium-sized pizza and a second planar surface sized to snugly receive and support a large-sized pizza.

The invention also provides a food container that can be preassembled at a manufacturing facility and nestingly stacked so that the boxes can be shipped in a space-efficient manner and efficiently stored assembled on the premises. When the boxes reach a retail-service facility they are immediately ready for use because of their preassembled condition.

Various advantages and features of novelty which characterize the invention are particularized in the claims forming a part hereof. However, for a better understanding of the invention and its advantages, reference is made to the drawings and to the accompanying description in which there are illustrated and described preferred embodiments of the invention.

BRIEF DESCRIPTION OF THE DRAWINGS

The figures forming a part of this specification convey the best mode for carrying out the invention known to the inventor at the time of filing the patent application. The figures are further presented to enable those skilled in the art to make and use the invention. After learning of the details of the invention as presented herein, including the figures, it is likely that alternative embodiments could be devised according to the invention, which have a much different appearance than the embodiments disclosed in the accompanying figures.

The figures forming a part of the specification convey utilitarian aspects of the invention and the preferred embodiments, and also include ornamental features which are not necessary to the utilization of the invention.

DETAILED DESCRIPTION OF THE PREFERRED EMBODIMENTS

FIGS. 1–6 depict a first embodiment of the invention, FIGS. 7–11 depict a second embodiment and FIGS. 12–15 depict a third embodiment. All the preferred embodiments share common characteristics which form a part of the claimed invention. With particular reference to FIGS. 1–6 the first embodiment will be described in detail. The second and third embodiments will then be described with reference to the features of the first embodiment.

Figure 1:
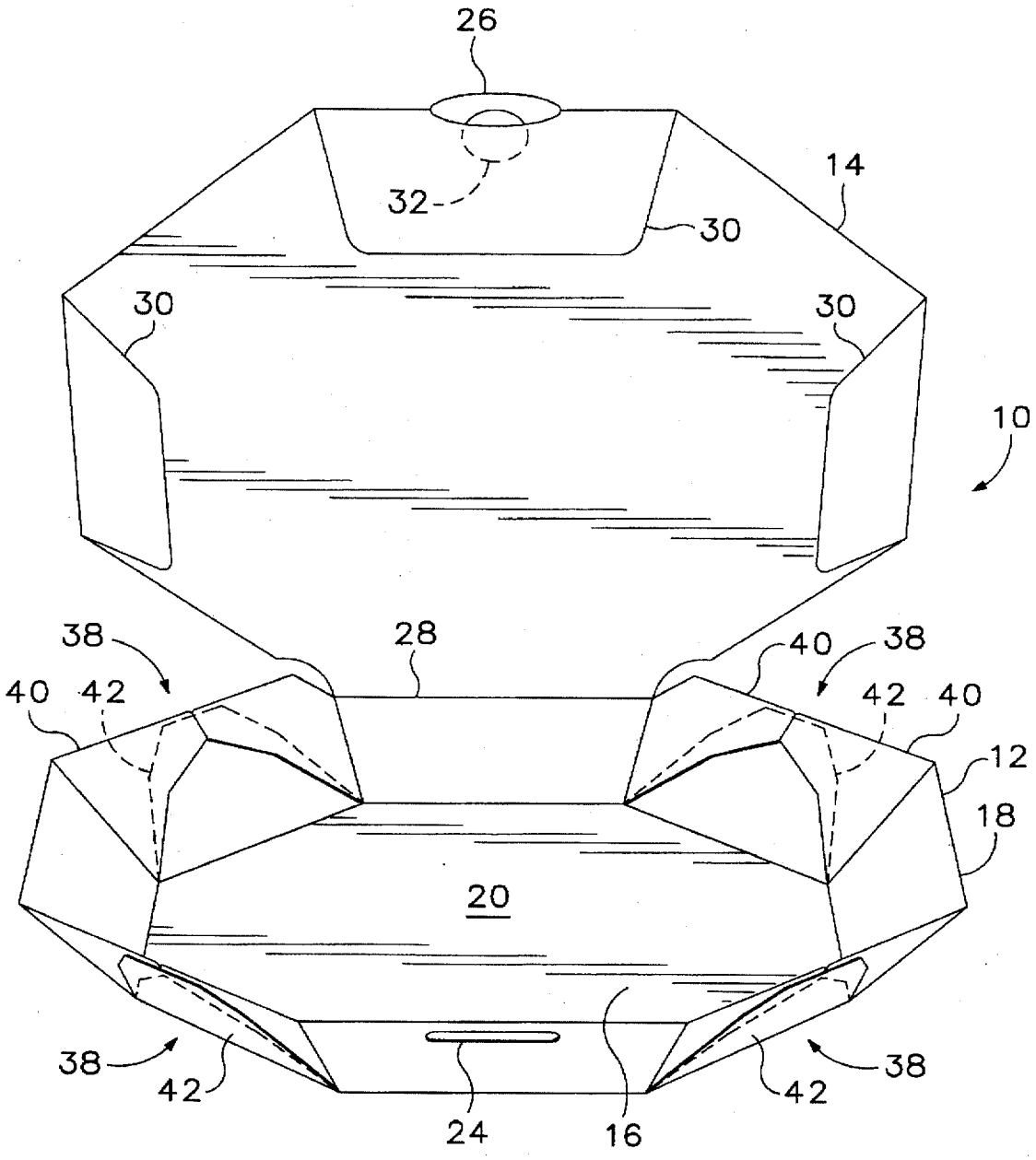
FIG. 1 is a front perspective view of a food container of the present invention in which the container is shown with a substantially flat element ajar from a concave element.

FIG. 1 depicts a food container 10 which includes a concave, or dished, element 12 and a substantially planar element 14.

Figure 2:
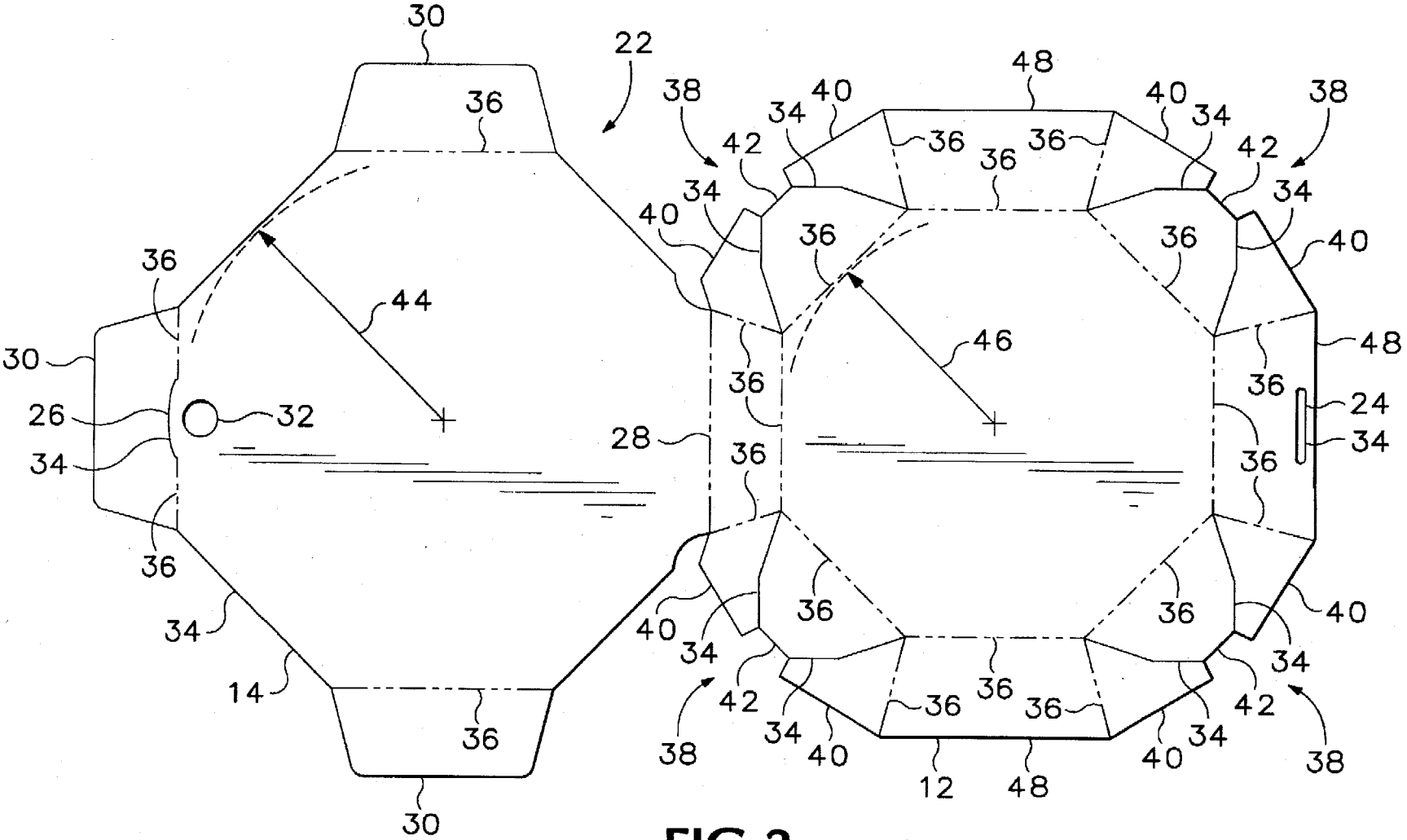
FIG. 2 is a plan view of a blank of corrugated material that can be configured into the food container of FIG. 1, wherein the dark solid lines represent cut lines and the light, broken lines represent fold lines.
Figure 3:
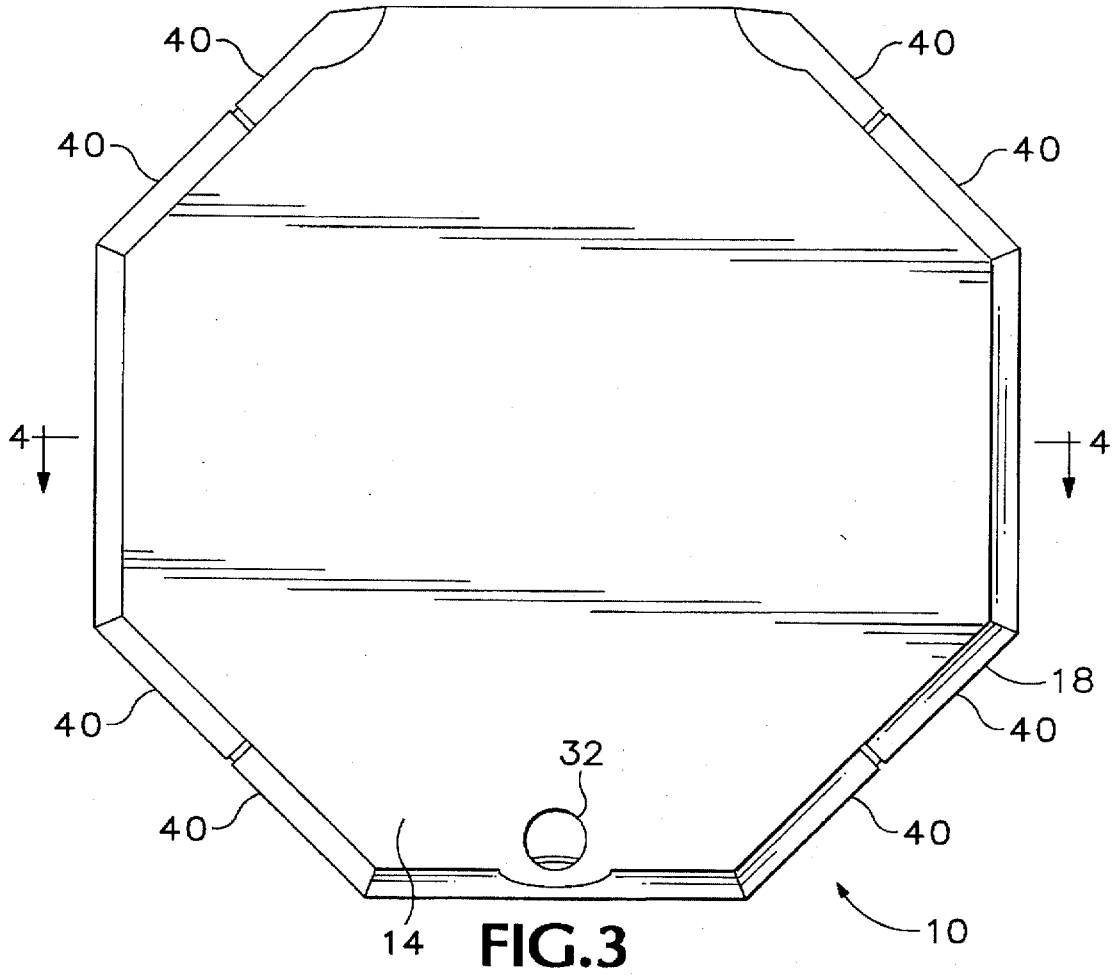
FIG. 3 is a plan view of the food container of FIG. 1 shown with the planar and concave elements in closed relationship.
Figure 4:
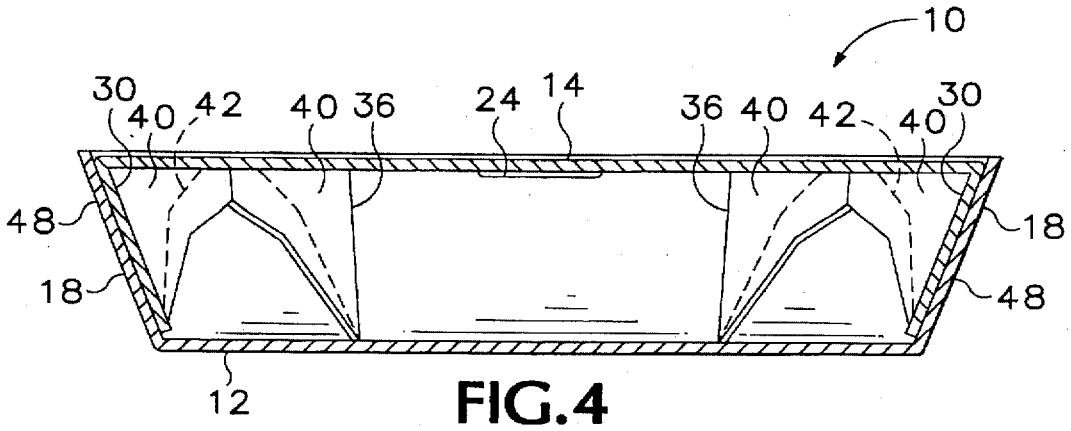
FIG. 4 is a cross-sectional view along line 4—4 of FIG. 3.
Figure 5:
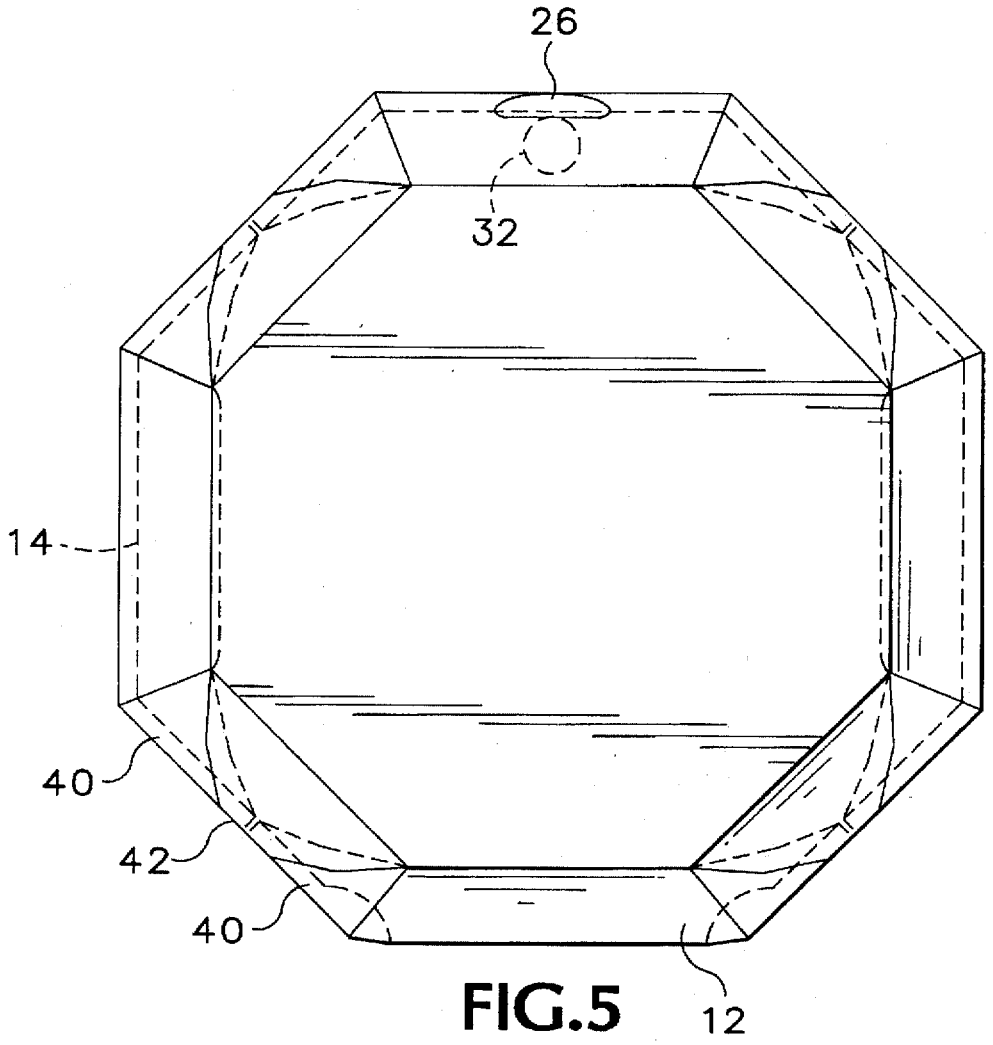
FIG. 5 is a second plan view of the food container of FIG. 1 shown with planar and concave elements in closed relationship.
Figure 6:
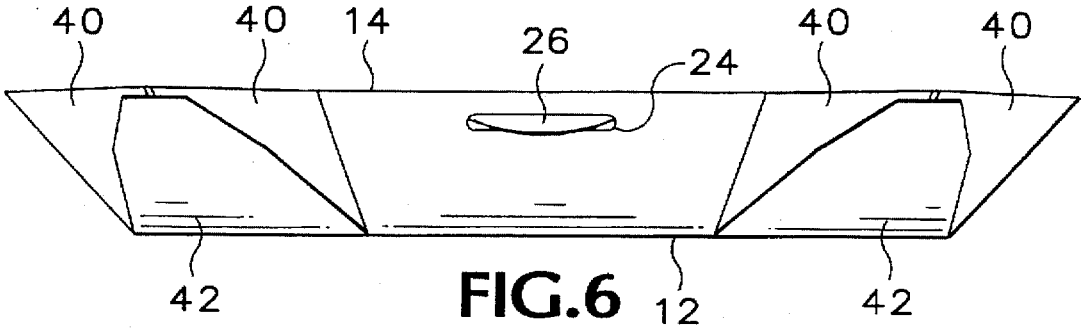
FIG. 6 is a front elevational view of the food container of FIG. 1 shown with the planar and concave elements in closed relationship.
Figure 7:
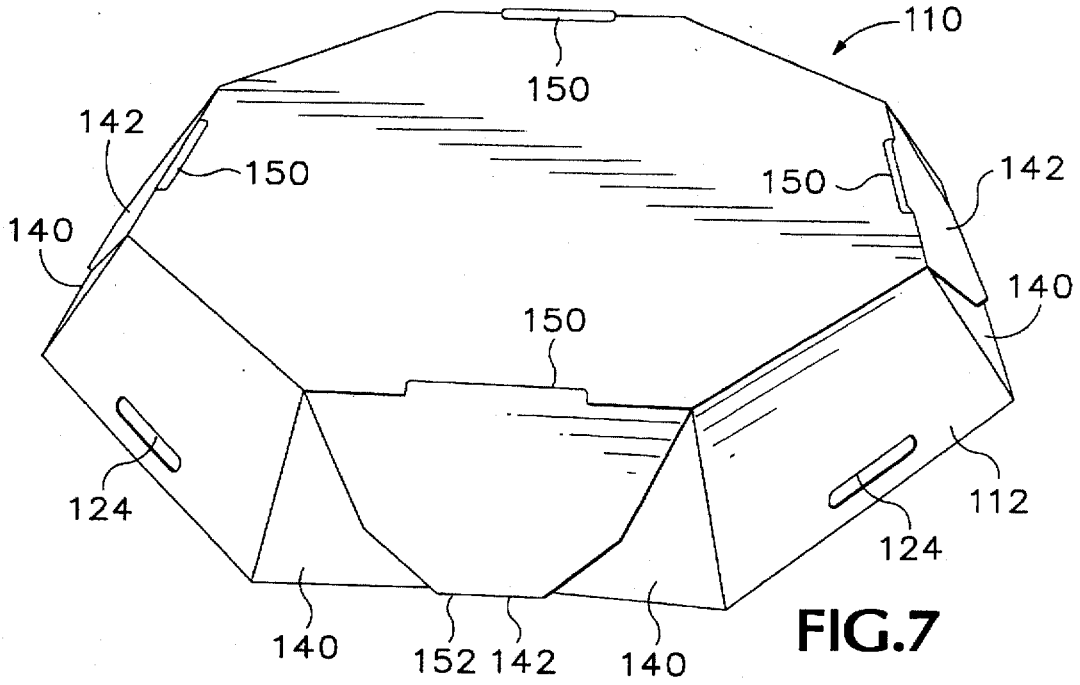
FIG. 7 is a perspective view of the concave element of a second embodiment of a food container of the present invention.
Figure 8:
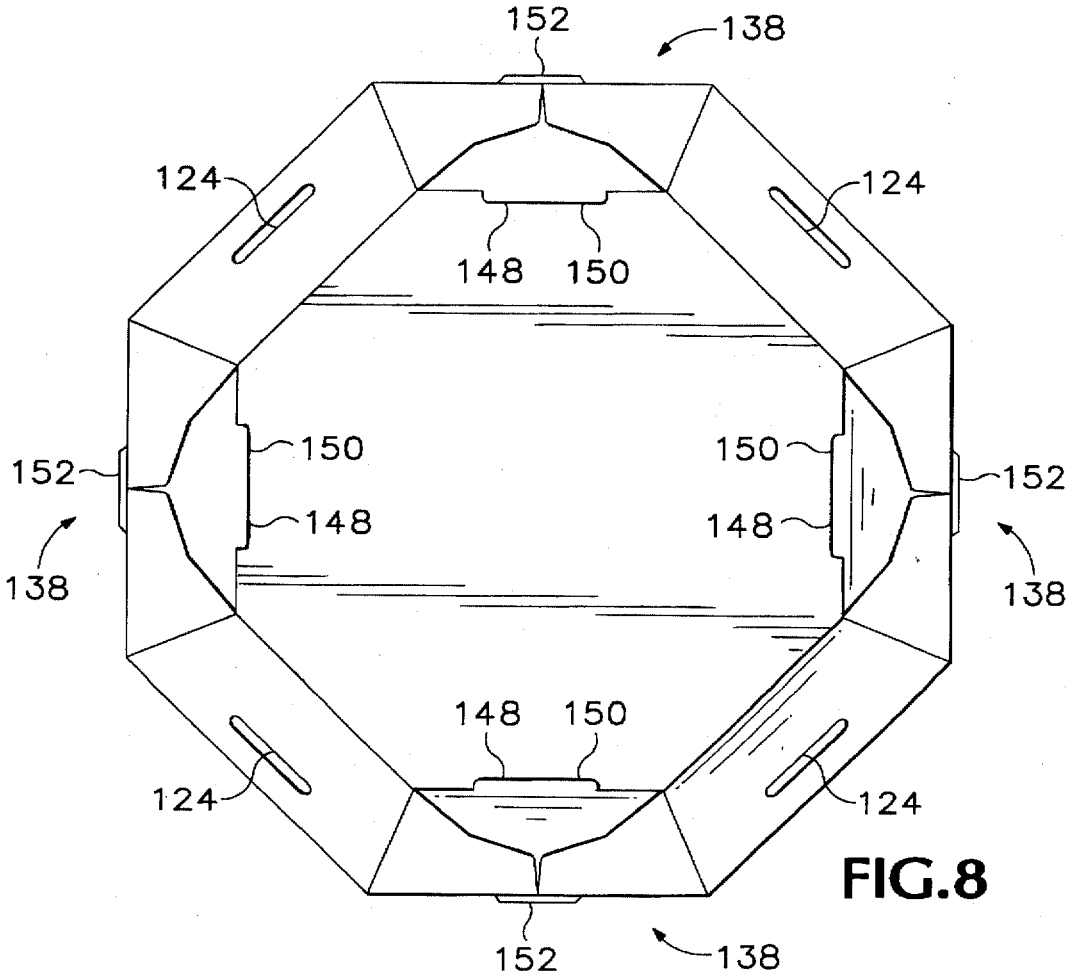
FIG. 8 is a plan view looking into the concave element shown in FIG. 7.
Figure 9:
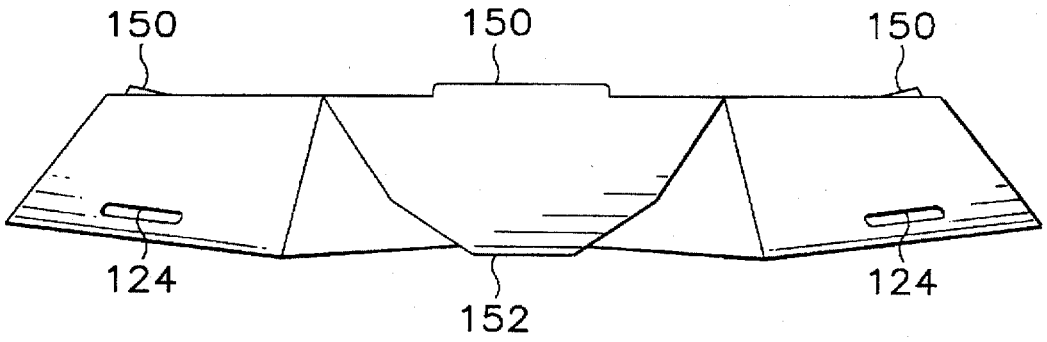
FIG. 9 is a side elevational view showing the food container of FIG. 7 oriented for use as a cover.

The concave element 12 has a flat portion 16 and a side portion 18 which forms an oblique angle to the flat portion 16. As shown, the side portion 18 forms an angle that is greater than 90° with an inside surface 20 of the flat portion 16. This arrangement obligates the side portion 18 to flare outward, thus producing the concave shape. Preferably, the side portion 18 is integral with the flat portion 16 as is best shown in FIG. 2 which depicts a blank 22 that has been cut and scored in preparation for being configured into the food container 10.

Referring further to FIG. 1, the side portion 18 is preferably configured as a series of connected facets extending around the margin of the flat portion 16 thus creating the appearance of a frustrum of an eight-sided pyramid (or pyramid having some other appropriate number of facets). Alternatively, the side portion 18 could be a smooth annular surface such as a portion of a cone surface.

At least one facet of the side portion 18 includes a cutout 24 for receiving a corresponding tab 26 associated with the planar element 14. When the planar element 14 is brought into proximate relationship with the concave element 12 and the tab 26 is inserted into the cutout 24, the tab and cutout act cooperatively as a fastener holding the elements 12, 14 of the container 10 closed. When closed, the container forms an internal chamber.

As shown in FIG. 1, the planar element 14 is hingedly connected to the concave element 16 along hinge line 28. The planar element 14 further includes depending flaps 30 that are hingedly connected to margins of the planar element 14. The planar element 14 also includes the aforementioned tab 26 and defines a hole 32 which is large enough to receive a finger as an aid to opening the container 10. The planar element 14 is sized to circumferentially fit within the upstanding side portion 18.

As mentioned, FIG. 2 depicts the blank 22 useful for fabricating the three-dimensional container 10. Preferably, the blank 22 is cut from sheet stock of suitable corrugated material. The corrugated material may be either double faced or single faced and the corrugations may be either linear or meandering. Corrugated material having meandering corrugations is disclosed in U.S. Pat. No. 5,314,738, hereby incorporated herein by reference.

Referring further to FIG. 2, cut lines 34 are represented as solid dark lines and fold lines 36 are represented as lighter dashed, or broken, lines. Cut lines 34 represent cuts through the entire thickness of material thus creating the overall shape of the blank, the cutouts 24 and 32, and the overlapping side portions. The fold lines 36 may be defined by scoring the corrugated material, providing short intermittent slits, or slitting one layer of the corrugation so that the material will easily fold along the selected line. Alternatively, it is not necessary to prepare the fold lines, but merely to fold the material along those lines at the time the container 10 is fabricated.

As noted above, the side portion 18 consists of a plurality of interconnected facets. In the preferred embodiment shown, four of the facets are foldover facets 38. The foldover facets are formed by cutting the material to create circumferential tabs 40 and intermediate, radial tabs 42. To form the concave element 12 the corresponding portion of the blank can be folded along its fold lines 36 so as to dish the sides toward the planar element 14. The cut lines separating the radial tabs from the circumferential tabs permit the radial tabs 42 to be bent outward while the circumferential tabs 40 move closer together as the concave portion 12 is dished. When a desired concavity is obtained, the circumferential tabs 40 are adhered to the corresponding radial tabs 42 thus holding concave portion 12 in its selected shape.

Alternatively, the circumferential and radial tabs 40, 42 could be coupled together during assembly by provision of interlocking tabs and slots (not depicted). Although the radial tabs 42 are depicted as being located along an outside surface of the side portion 18, they could also be located along an inside surface with no change in the utility of the container 10.

FIG. 2 also depicts an effective radius 44 which represents an effective radius associated with the planar element 14. The effective radius is the radius of the largest circular food item or the like that can rest on the planar element without overlapping fold lines 36. Effective radius 46 refers to a radius associated with the largest circular food item or the like that can fit on the flat portion 16 of the concave element 12 without overlapping any fold lines 36. As shown in the preferred embodiment, effective radius 44 is larger than effective radius 46. Accordingly, when the food container is used for circular foods such as pizza, it can be seen that the element associated with the larger effective radius provides a larger flat surface for supporting the food. Accordingly, as shown in this preferred embodiment, a larger pizza could be supported on the planar element 14 than can be supported, in a flat manner, on the concave element 12. Accordingly, the container 10 may be used for storage and transportation of multiple sizes of food product.

The size of the container 10 may be scaled up or down to provide the desired sizes for effective radii 44 and 46. Thus, the container 10 could be sized so that a medium pizza would fit snugly on the flat portion 16 of the concave element 12 and a large pizza would fit snugly on the planar element 14. Although the invention is described in terms of its utility for storing pizza, it is also intended that the invention could be sized to accommodate other food such as sandwiches, pies, or cakes.

Referring to FIGS. 1–4, the flaps 30 are located so as to interact with the concave element 12 at the side portion facets 48 which do not include the circumferential and radial tabs 40, 42. The flaps 30 are thusly aligned to provide additional strengthening along the side portion 18. Thus, all facets of the side portion 18 have some amount of overlapping material except for the facet immediately below the hinged line 28.

FIGS. 7–11 depict a container 110, a second embodiment of the present invention. Many features and elements of the container 110 are substantially similar to the container 10 described above. In the following discussion, there is some note of the similarities between the containers 10 and 110, but the discussion is primarily directed to those elements or features that are different.

Figure 10:
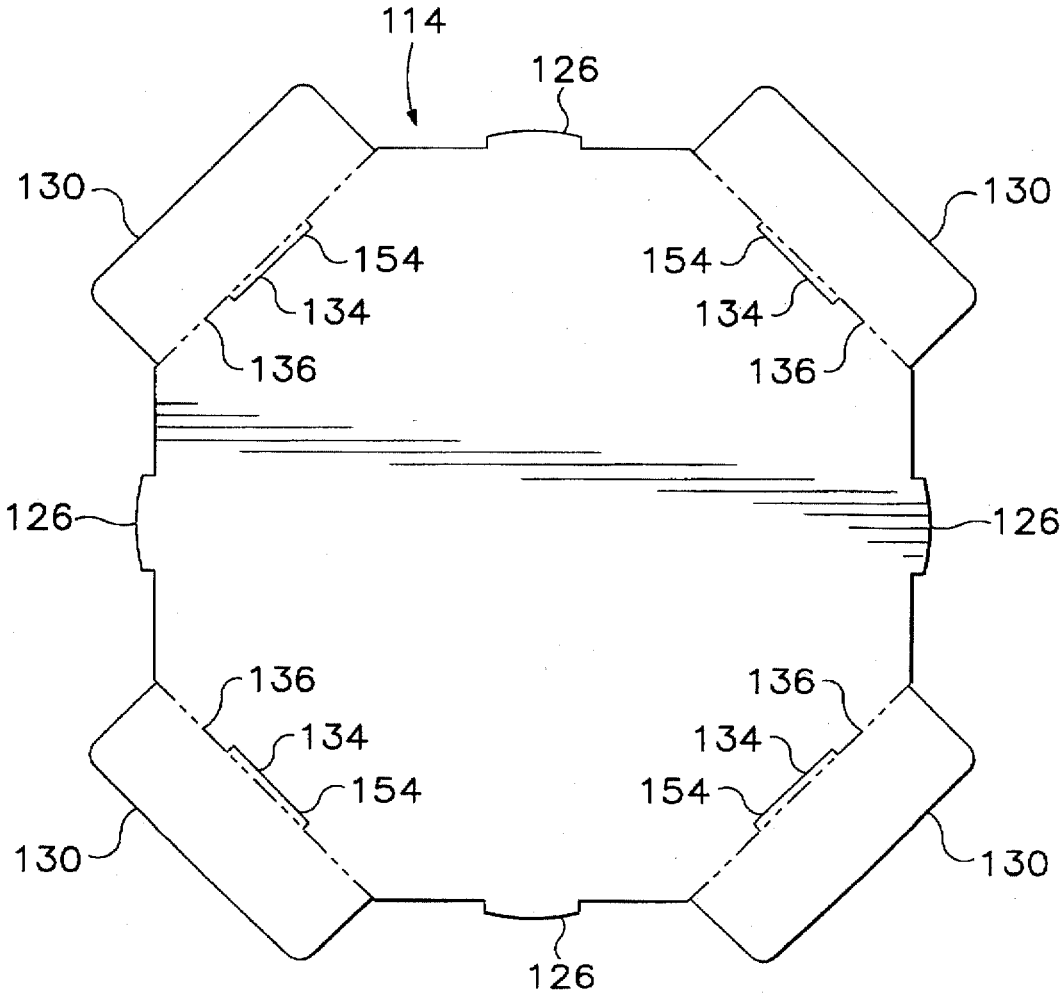
FIG. 10 is a plan view of a blank of a planar element adapted for use with the concave element shown in FIG. 7.

The container 110 includes a concave element 112 and a separate planar element 114 (FIG. 10). The concave element 112 further includes circumferential tabs 140 which are adhered to radial tabs 142 thus forming the concave shape of the concave element 112. Concave element 112 also includes radial tab cuts 148 which create small feet 150 whenever the foldover facets 138 are formed. Additionally, in this embodiment, the radial tabs 142 are cut longer than the circumferential tabs 140 so that the radial tabs 142 protrude slightly above the rim of the concave element 112, also forming feet 152. Accordingly, the container 110 rests upon feet 150 or feet 152 depending upon which element is oriented downward and serving as a base for the food.

In this embodiment, the planar element 114 and the concave element 112 are preferably discrete elements, that is they are formed from separate blanks. Accordingly, there is no hinged connection between the two elements. To provide for more secure attachment, the concave element is provided with a plurality of cutouts 124 (FIG. 9) for receiving a corresponding number of tabs 126 (FIG. 10) which are adapted to fit in the cutouts 124.

Figure 11:
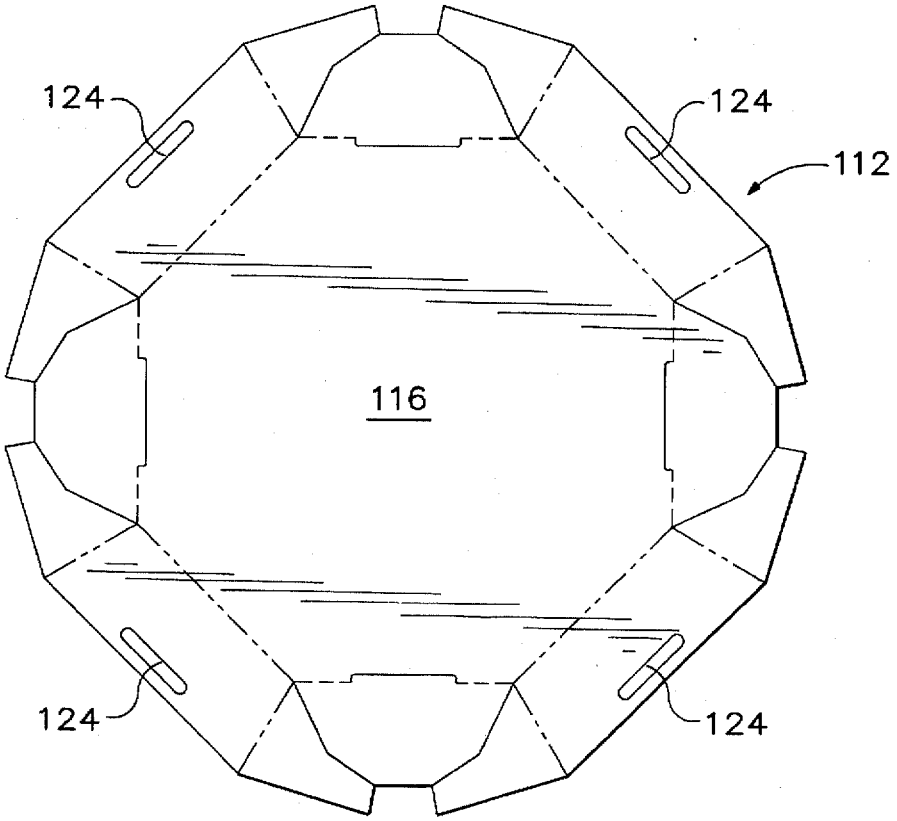
FIG. 11 is a plan view of a blank of the concave element of the food container of FIG. 7.
Figure 12:
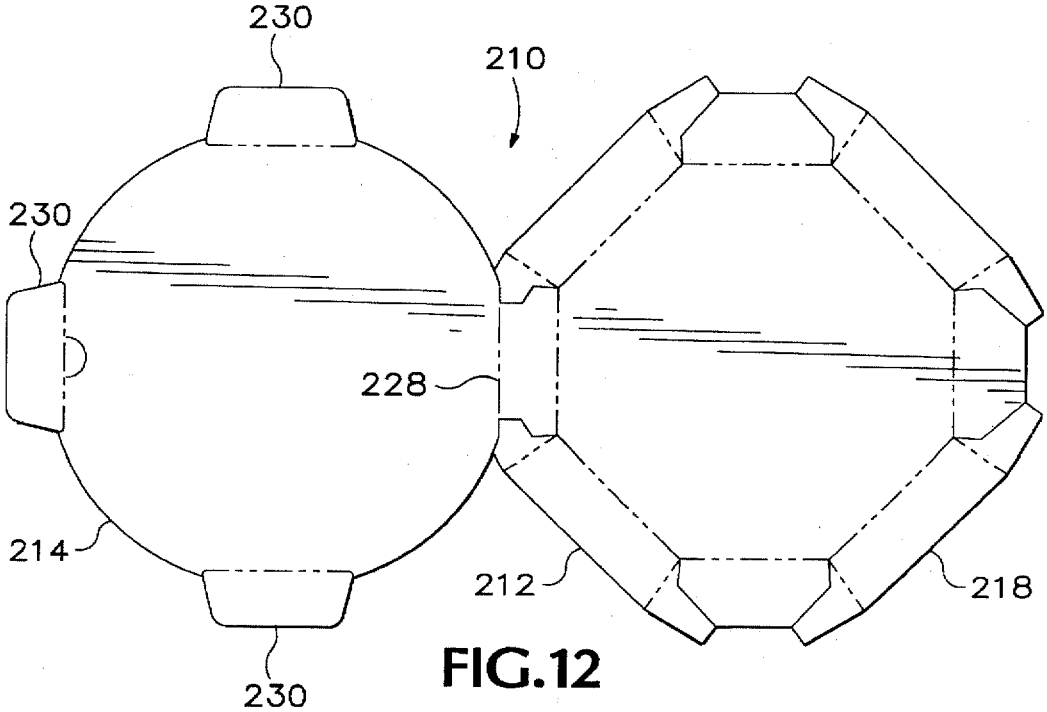
FIG. 12 is a plan view of a blank that can be configured into a third embodiment of a food container of the present invention.
Figure 13:
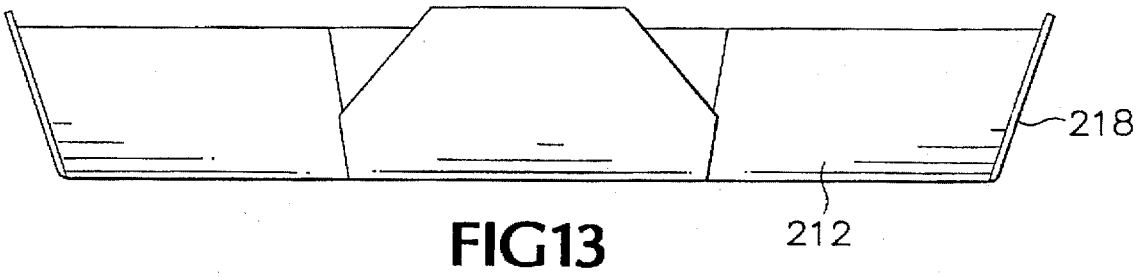
FIG. 13 is a side elevational view of the food container of FIG. 12 in an assembled condition.
Figure 14:
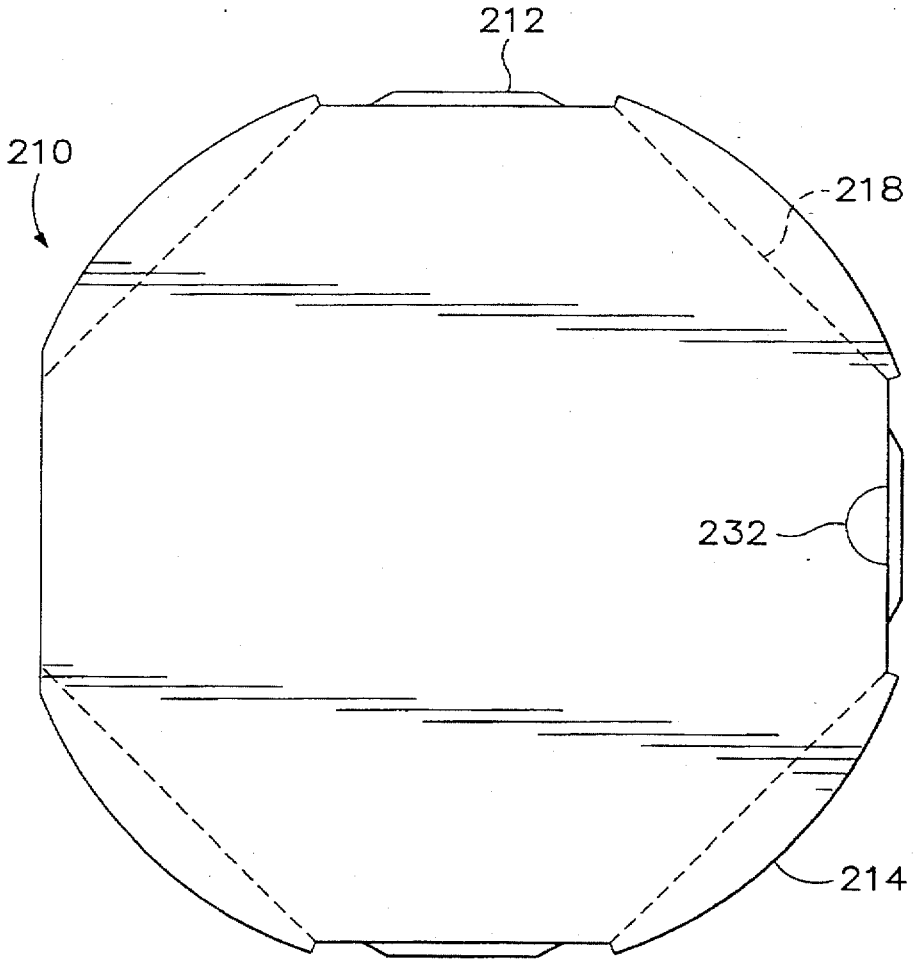
FIG. 14 is a first plan view of the food container of FIG. 12 in an assembled condition.
Figure 15:
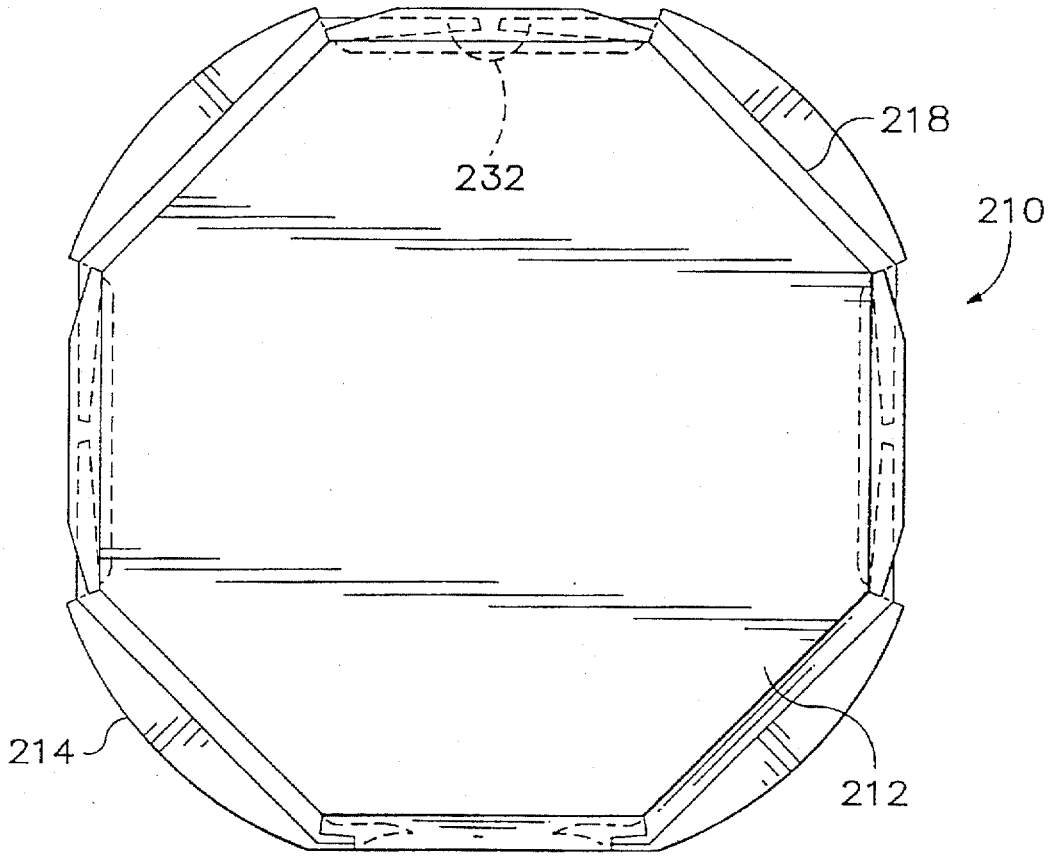
FIG. 15 is a second plan view of an assembled food container of FIG. 12.

Blanks for forming the container 110 are shown in FIGS. 10 and 11. FIG. 10 depicts a blank for the planar element 114 and includes cut lines 134 and fold lines 136. Along the fold line 136 between flaps 130 and the main portion of the planar element 114, further cuts 134 are provided which provide small feet-like projections 154. Further, the feet-like projections 154 will be aligned with the feet 152 associated with the radial tabs 142 when the planar element 114 is coupled to the concave element 112.

As described in connection with the container 10, the container 110 also includes effective radii (not shown) associated with the planar element 114 and the flat portion 116 of the concave element 112. Again, the effective radii will be substantially different from each other so as to accommodate different sizes of food.

A third embodiment of the invention is shown in FIGS. 12–15 which disclose a food container 210 which also includes many similar features and elements as described in connection with the containers 10 and 110 above. Container 210 includes a planar element 214 and a concave element 212 which are hingedly connected at a hinge line 228. Similarly to the container 10, the planar element 214 of this third embodiment includes flaps 230 which nest within the side portion 218 of the concave element 212. A notable difference associated with the present embodiment is that the planar element 214 is larger and more rounded than the planar element associated with the first and second embodiments. Accordingly, when the two elements 212, 214 are brought into a closing relationship, the planar element 214 extends radially outward beyond the side portion 218 of the concave element 212. (I.e., as can best be seen in FIGS. 14 and 15, the planar element 214 extends beyond the side portion 218 of the concave element 212 along the circumference of the planar element 214 which does not include the flaps 230.) This feature provides several advantages. Most notable is that when the container 210 is being used for larger food articles such that the planar element 214 serves as a bottom on which the food is placed, the oversized planar element 214 provides an easier grip with which to hold and support the planar element 214, and thus the entire container 210 and contents.

A hole 232 is defined by the planar element 214 as a finger hold to assist the user in separating the planar element 214 from the concave element 212.

Figure 16:
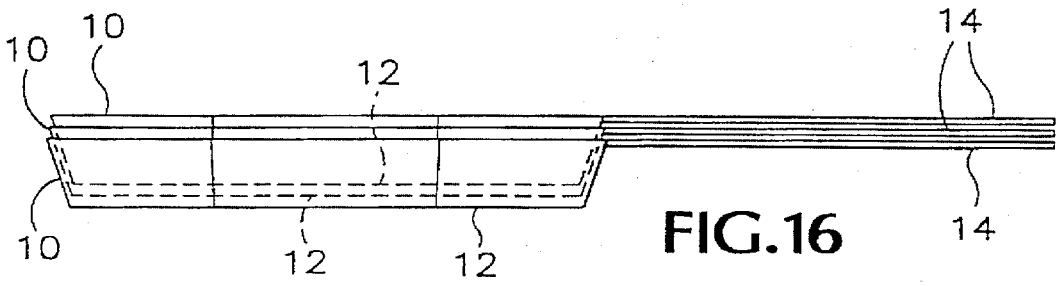
FIG. 16 is a side elevational view showing a plurality of food containers of the present invention in a nested-stack configuration for shipment.

FIG. 16 depicts a representative manner in which assembled containers 210, 212 can be stacked for shipment and/or storage. The obliquely angled side portion 18 assists in allowing the containers to be nested one within the other to provide a compact, space-efficient shipping and storing configuration. The containers 110 similarly nest (not shown) but do not appear as shown in FIG. 16 because the planar element 114 associated with that embodiment is separately packed. Accordingly, containers according to the present invention may be prefabricated at a manufacturing facility and nestingly packed together and efficiently shipped to retail facilities where they will be used.

Numerous characteristics and advantages of the invention have been set forth in the foregoing description, together with details of the structure and function of the invention. The novel features hereof are pointed out in the appended claims. The disclosure is illustrative only, and changes may be made in detail, especially in matters of shape, size, and arrangement of parts within the principle of the invention to the full extent indicated by the broad general meaning of the terms in the claims.

We claim:

1. A food container, comprising first and second substantially planar surfaces adapted to be spaced apart by a multi-faceted side portion, the multi-faceted side portion including multi-tab facets and single-panel facets, the multi-panel facets having overlapping radial and circumferential tabs that are adhesively coupled together, the first substantially planar surface being smaller than the second substantially planar surface whereby the container can receive and flatly support a food item of a first size when the first substantially planar surface is oriented downward and the container can receive and flatly support a food item of a second size when the second substantially planar surface is oriented downward and the food item of the second size can not be flatly supported by the first substantially planar surface and wherein the side portion includes a plurality of elongate slots and the first substantially planar portion includes a corresponding number of tabs that are sized to be received in the slots, and a plurality of flaps hingedly coupled to the first substantially planar portion along respective hinge lines, wherein cuts located along the respective hinge lines define a respective number of projections that support the container when the first substantially planar portion flaps are received proximate the side portion and the container is oriented so that the first substantially planar portion is downward.

2. The food container of claim 1 wherein the radial tabs extend beyond a height of the side portion thereby defining a plurality of feet to support the container when the feet are oriented downward.

3. The food container of claim 2 wherein the feet and the projections are aligned when the first and second substantially planar portion are coupled so that the projections and feet cooperate to support the container when the container is oriented with the feet and projections downward.

* * * * *